US005974603A

United States Patent [19]

Frazier

[11] Patent Number: 5,974,603

[45] Date of Patent: Nov. 2, 1999

[54] FORKED SHOWER CURTAIN CONSTRUCTION

[76] Inventor: Steve Frazier, 206 W. Nay St., Holden, Mo. 64040

[21] Appl. No.: 08/824,859

[22] Filed: Mar. 26, 1997

[51] Int. Cl.[6] ..... A47K 3/08

[52] U.S. Cl. ..... 4/558; 4/608; 4/609

[58] Field of Search ..... 4/558, 557, 607, 4/608, 609, 605

[56] References Cited

U.S. PATENT DOCUMENTS

| | | | |
|---|---|---|---|
| 2,305,502 | 1/1942 | Rous | 4/608 |
| 2,776,439 | 1/1957 | Rondinelli . | |
| 3,035,275 | 5/1962 | Strebeigh | 4/608 |
| 4,126,172 | 11/1978 | Faragher, Jr. | 160/126 |
| 5,421,393 | 6/1995 | Wolfe | 160/349.1 |
| 5,495,628 | 3/1996 | Logan | 4/558 |

*Primary Examiner*—David J. Walczak
*Attorney, Agent, or Firm*—Kenneth L. Tolar

[57] ABSTRACT

A forked shower curtain construction 10 for bathtub receptacles 200. The curtain construction 10 comprises a generally elongated rectangular main shower curtain panel member 20 and an auxiliary shower curtain panel member 30 releasably secured to the lower portion of the main shower curtain panel member 20 by a zip-lock type releasable securing means 25 and 35.

2 Claims, 2 Drawing Sheets

FORKED SHOWER CURTAIN CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of shower curtain constructions in general, and in particular to a forked bottom shower curtain construction having a removable auxiliary lower panel member.

2. Description of Related Art

As can be seen by reference to the following U.S. Pat. Nos. 2,776,439; 4,126,172; 5,421,393; and 5,495,628; the prior art is replete with myriad and diverse shower curtain constructions.

While all of the aforementioned prior art constructions are more than adequate for the basic purpose and function for which they have been specifically designed, they are all uniformly deficient with regard to providing a means for simplifying the act of cleaning the lower interior portion of the shower curtain, which seems to act as a magnet for dirt, soap scum, mildew, and the like.

In the past, it was extremely difficult to accomplish this task due to the mass of the conventional shower curtain constructions and the awkwardness in manipulating such a large amount of material.

As a consequence of the foregoing situation, there has existed a longstanding need for a new type of shower curtain construction which not only covers both sides of the rim of the bathtub, but which also includes a relatively small detachable interior panel member which can easily be removed for cleaning. The provision of such a construction is a stated objective of the present invention.

BRIEF SUMMARY OF THE INVENTION

Briefly stated, the forked shower curtain construction that forms the basis of the present invention comprises in general, a main shower curtain panel unit and an auxiliary shower curtain panel unit which cooperates with the main shower curtain panel unit to form the forked lower configuration of the shower curtain construction.

As will be explained in greater detail further on in the specification, the forked lower portion of the shower curtain construction is dimensioned and designed to cover the interior, exterior and top portions of the exterior rim of a conventional bathtub construction.

In addition, the auxiliary shower curtain panel unit cooperates in a zip lock type manner with the main shower curtain panel unit such that the auxiliary shower curtain panel unit may be easily detached for cleaning and reattached for continued usage in its intended manner.

BRIEF DESCRIPTION OF THE SEVERAL VIEW OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
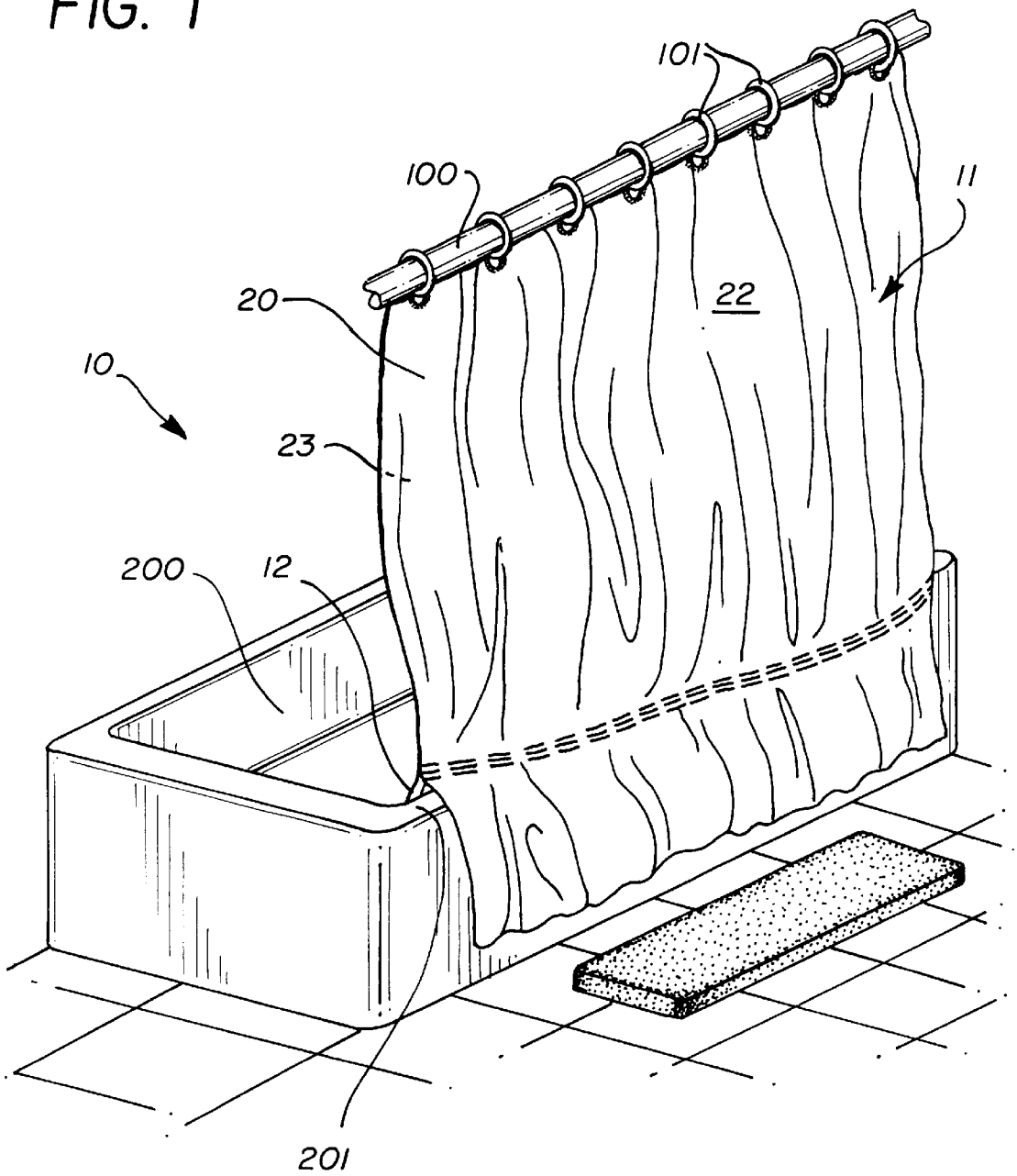
FIG. 1 is a perspective view of the forked shower curtain construction that forms the basis of the present invention installed on a conventional bathtub.

As can be seen by reference to the drawings, and in particularly to FIG. 1, the forked shower curtain construction that forms the basis of the present invention is designated generally by the reference number 10. The construction 10 comprises in general, a main shower curtain panel unit 11 and an auxiliary shower curtain panel unit 12. These units will now be described in seriatim fashion.

Figure 2:
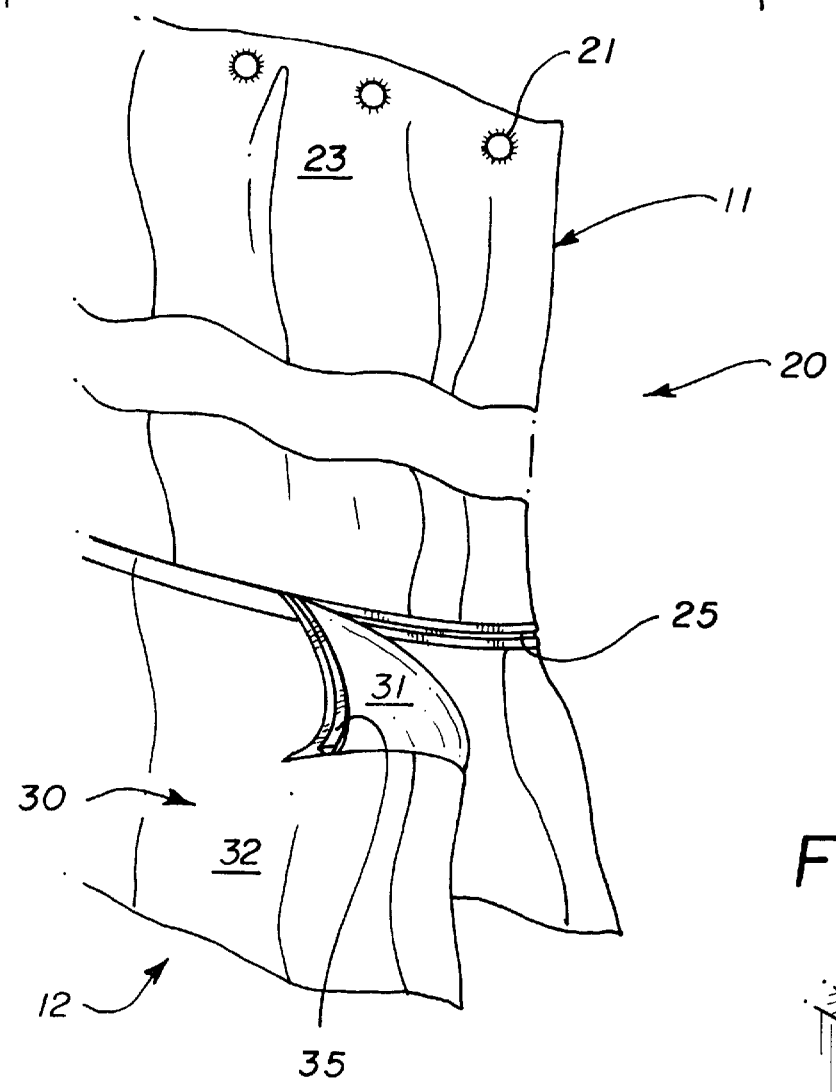
FIG. 2 is an isolated perspective view of the forked shower curtain construction.

As shown in FIGS. 1 and 2, the main shower curtain panel unit 11 comprises in general an enlarged generally rectangular main shower curtain panel member 20 provided with a plurality of conventional reinforced apertures 21 dimensioned to receive a plurality of shower curtain hooks 101 to suspend the main shower curtain panel member 20 from a shower curtain rod 100.

In addition, the main shower curtain panel member 20 has an exterior face 22 and an interior face 23. The lower portion of the interior face 23 of the main panel member 20 is provided with an elongated transverse generally dove-tail groove 25 whose purpose and function will be described presently.

Figure 3:
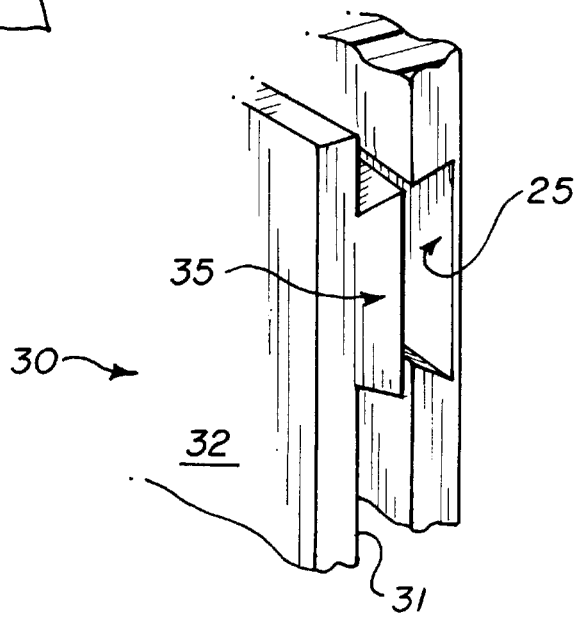
FIG. 3 is an isolated detail view of the operative connection between the main and auxiliary shower curtain panel units.

As shown in FIGS. 1 through 3, the auxiliary shower curtain panel unit 12 comprises a relatively narrow elongated generally rectangular auxiliary shower curtain panel member 30 having a front face 31 and a rear face 32.

In addition, the upper end of the front face 31 of the auxiliary shower curtain panel member 30 is provided with an elongated transverse generally dove-tailed projection 35. The dove tail projection 35 may be resiliently deformed to operatively engage and disengage the dove tail projection 35 relative to the dove tail groove 25 for connecting and disengaging the auxiliary shower curtain panel member 30 to the main shower curtain panel member 20.

As shown in FIG. 1, the forked shower curtain construction 10 of this invention is intended for use by being suspended over the front rim 201 of a bathtub 200 by a conventional shower pole 100 and hook 101 arrangement. The lower portion of the shower curtain construction 10 covers the top, front, and rear surfaces of the front rim 201 of the bathtub 200.

In addition, in its operative mode of disposition, the lower portion of the main shower curtain panel member 20 is disposed outside of the bathtub receptacle 200. Whereas, the auxiliary shower curtain panel member 30 is draped over the top of the rim 201 and is suspended adjacent the rear surface of the front rim 201 of the bathtub 200.

After the shower curtain construction has undergone a period of use, the rear face 32 of the auxiliary shower curtain panel member 30 will become contaminated by dirt, soap scum, mold or the like. Whereupon, the user will releasably disengage the auxiliary shower curtain panel member 30 from the main shower curtain panel member 20, so that the auxiliary shower curtain panel member 30 may be cleaned in a relatively small basin or receptacle without the need to take down the entire shower curtain construction 10.

Once the auxiliary shower curtain panel member 30 has been cleaned, it may be reattached to the main shower curtain panel member 20 in an action similar to closing a zip-lock plastic bag, when the dovetail projection 35 is resiliently deformed into engagement with the dove tail groove 25 in the main shower curtain panel member 20.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A forked shower curtain for mounting adjacent a bathtub having an outer wall, said outer wall having an inner and outer surface, said shower curtain comprising:

an enlarged, generally rectangular main shower curtain member having an exterior side, an interior side, an upper portion and a lower portion, said main shower curtain member disposed exteriorly of the bathtub with the interior side facing the outer surface of said bathtub outer wall;

a relatively narrow, generally rectangular auxiliary shower curtain member dimensioned to cover the lower portion of the main shower curtain member, said auxiliary curtain member having an exterior surface and an interior surface, the exterior surface facing the inner surface of the bathtub outer wall;

a securing means for releasably connecting the auxiliary shower curtain member to the interior side of the main shower curtain member proximal its lower portion whereby the auxiliary member is disposed within the bathtub adjacent the inner surface of the bathtub outer wall, said securing means including an elongated transverse groove disposed on one of said curtain members and an elongated projection disposed on the other of said curtain members wherein the elongated transverse projection may be resiliently deformed into interlocking engagement with said elongated transverse groove.

2. The shower curtain construction of claim 1 wherein said elongated transverse projection is a dove tail projection and said elongated transverse groove is a dove tail groove.

* * * * *